US007971609B2

(12) United States Patent
Loong

(10) Patent No.: US 7,971,609 B2
(45) Date of Patent: Jul. 5, 2011

(54) WATER SAVING DEVICE

(75) Inventor: Meng Loong, Singapore (SG)

(73) Assignee: JVL Engineering Pte Ltd., Singapore (SG)

( * ) Notice: Subject to any disclaimer, the term of this patent is extended or adjusted under 35 U.S.C. 154(b) by 405 days.

(21) Appl. No.: 10/570,064

(22) PCT Filed: Feb. 7, 2005

(86) PCT No.: PCT/SG2005/000028

§ 371 (c)(1),
(2), (4) Date: Mar. 1, 2006

(87) PCT Pub. No.: WO2005/075754

PCT Pub. Date: Aug. 18, 2005

(65) Prior Publication Data

US 2008/0099094 A1 May 1, 2008

(30) Foreign Application Priority Data

Feb. 6, 2004 (SG) ..... 200400564-1
Oct. 27, 2004 (AU) ..... 2004906200

(51) Int. Cl.
*F16L 55/00* (2006.01)

(52) U.S. Cl. ..... 138/43; 138/46; 239/428.5

(58) Field of Classification Search ..... 138/41, 138/42, 43, 45, 46; 239/428.5
See application file for complete search history.

(56) References Cited

U.S. PATENT DOCUMENTS 1,692,467 A * 11/1928 Quinlan ..... 138/43
2,787,452 A * 4/1957 Aghnides ..... 239/428.5
2,797,906 A * 7/1957 Aghnides ..... 261/76
2,837,323 A * 6/1958 Goodrie ..... 239/579
2,896,863 A * 7/1959 Shames et al. ..... 239/428.5
2,904,263 A * 9/1959 Tate et al. ..... 239/494
2,929,567 A * 3/1960 Aghnides ..... 239/428.5
2,941,729 A * 6/1960 Goodrie ..... 239/428.5
2,990,122 A * 6/1961 Blumberg et al. ..... 239/441
2,995,309 A * 8/1961 Moen ..... 239/428.5
3,014,667 A * 12/1961 McLean et al. ..... 239/428.5
3,042,079 A * 7/1962 Swift et al. ..... 138/42
3,334,818 A * 8/1967 Moen ..... 239/428.5
3,524,591 A * 8/1970 Samuels etal. ..... 239/428.5
3,554,451 A * 1/1971 Aghnides ..... 239/428.5
3,680,793 A * 8/1972 Tate et al. ..... 239/468
3,868,973 A * 3/1975 Bierman et al. ..... 138/43
3,902,671 A * 9/1975 Symmons ..... 239/428.5
4,119,276 A * 10/1978 Nelson ..... 239/590.3
4,211,368 A * 7/1980 Legros et al. ..... 239/315
4,537,360 A 8/1985 Bock
4,637,552 A * 1/1987 Finkbeiner et al. ..... 239/428.5
4,657,186 A 4/1987 Shapiro (Continued)

FOREIGN PATENT DOCUMENTS

DE 196 14 302 10/1997

(Continued)

*Primary Examiner* — James F Hook

(74) *Attorney, Agent, or Firm* — Robert J. Yarbrough; Lipton, Weinberger & Husick

(57) ABSTRACT

A water saving device for use at or near a water outlet has a first water flow regulating element; a second water flow regulating element disposed downstream of the first regulating element; and a chamber formed between the first and second regulating elements. All of one or more water flow regulating parts of the second regulating element are made from substantially solid material.

18 Claims, 4 Drawing Sheets

U.S. PATENT DOCUMENTS

| | | | | |
|---|---|---|---|---|
| 4,730,786 | A * | 3/1988 | Nelson | 239/590.3 |
| 5,011,075 | A * | 4/1991 | Vandiver | 236/48 R |
| 5,014,372 | A * | 5/1991 | Thrasher et al. | 4/541.6 |
| 5,114,072 | A | 5/1992 | Barhydt, Sr. | |
| 5,152,463 | A * | 10/1992 | Mao et al. | 239/402 |
| 5,242,119 | A | 9/1993 | Jariyasunant | |
| 5,467,929 | A * | 11/1995 | Bosio | 239/428.5 |
| 6,631,737 | B1 * | 10/2003 | Kipping | 138/43 |
| 7,370,675 | B2 * | 5/2008 | Cancade et al. | 138/45 |
| 7,581,685 | B2 * | 9/2009 | Belisle | 239/428.5 |
| 2006/0151635 | A1 * | 7/2006 | Laker | 239/533.1 |

FOREIGN PATENT DOCUMENTS

| | | |
|---|---|---|
| DE | 200 07 723 | 8/2000 |
| GB | 2 337 099 | 11/1999 |
| JP | 09095985 | 4/1997 |
| JP | 10025779 | 1/1998 |
| JP | 2001152499 | 6/2001 |
| NL | 1010592 | 10/1999 |
| WO | 9819797 A1 | 5/1998 |

* cited by examiner

| Applications | Existing Water Saving Device | | Water Saving Device in accordance with the example embodiments | |
|---|---|---|---|---|
| | Pressure (Bar) | Flow Rate (Litre/min) | Pressure (Bar) | Flow Rate (Litre/min) |
| Water Tap | 1.4 | 28.8 | 2.4 | 13.8 |
| Shower | 1.4 | 22.2 | 2.4 | 10.6 |

Figure 3

WATER SAVING DEVICE

FIELD OF INVENTION

The present invention relates broadly to a water saving device for use at or near a water outlet.

BACKGROUND

In former times, fresh water was freely available and was thought by some to be an inexhaustible resource. Many communities provided unlimited supplies of water to commercial and residential consumers at a very low cost. Thus, with water conservation having a low priority, little thought was given to it in the design of water-using appliances.

Currently, a combination of factors such as rising urban populations, diminishing water tables and near drought condition in various parts of the world, have combined to diminish the amount of fresh water available to the public. In response to these factors, the public has become aware of the necessity and in some cases, the urgency of water conservation measures. In this regard, water rates are being implemented in many communities throughout the world.

As a result of such water conservation efforts now taking place, both voluntarily and as a result of legislation, homemakers and business managers alike are actively seeking ways to conserve this precious resource. Manufacturers of water consuming appliances, such as taps, shower handles and dishwashers, are developing new products, which perform efficiently, while consuming less water than earlier models. As a result, new appliances are gradually replacing the older appliances, which may be phased out of service over about a ten year period, for example, this will result in significant water conservation.

Several problems may be encountered when using the conventional water saving devices. One of the problems is that the water pressure out from the water saving devices is typically reduced as a result of reduced water flow. It would be desirable to minimise the reduction of water pressure for a given reduced water flow in order to maintain a perception of sufficient water flow for the consumer.

SUMMARY

In accordance with an aspect of the present invention, there is provided a water saving device for use at or near a water outlet, the device comprising: a first water flow regulating element; a second water flow regulating element disposed downstream of the first regulating element; a chamber formed between the first and second regulating elements; wherein all of one or more water flow regulating parts of the second regulating element are made from substantially solid material.

The chamber may separate the first and second regulating elements by a distance chosen such that a water force prior to the second regulating element has a desired value.

The distance may be about ⅓ of a diameter of a water supply line for the outlet.

The second regulating element may be mounted within the chamber in a substantially airtight manner under water flow.

The device may further comprise one or more netting elements disposed downstream of the second regulating element.

The first regulating element may comprise an array of holes. The number or holes may range from 1 to 4.

The holes may be substantially circular in shape. The diameter of the holes may be from about 1.5 mm to 3 mm.

The distance between the first and second water flow regulating elements may be adjustable.

BRIEF DESCRIPTION OF DRAWINGS

Embodiments of the invention will be better understood and readily apparent to one of ordinary skill in the art from the following written description, by way of example only, and in conjunction with the drawings, in which:

FIG. 3 shows a table illustrating a comparison in water flow and water pressure between an existing water saving device and a water saving device according to the example embodiments.

DETAILED DESCRIPTION

Figure 1A:
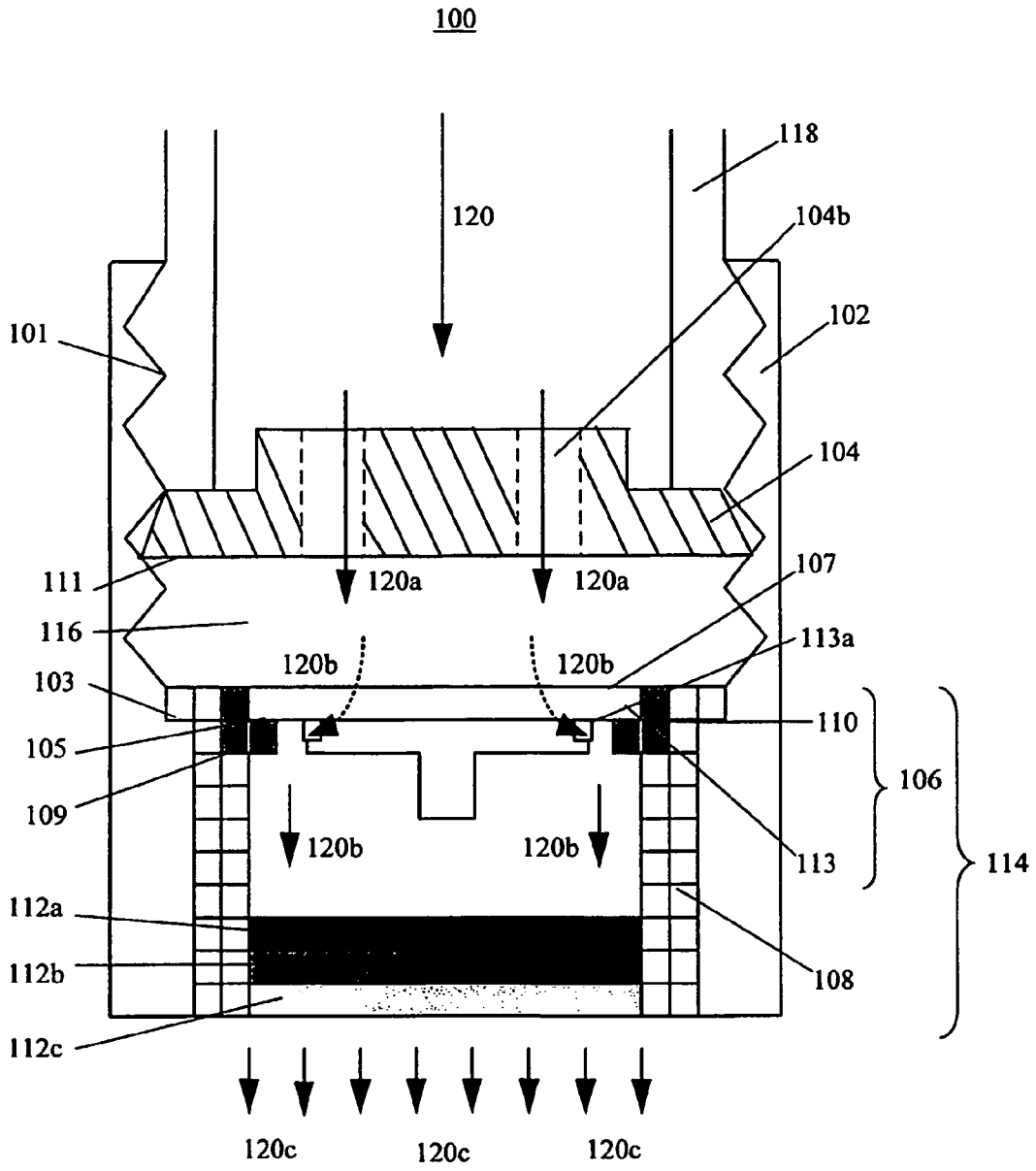
FIG. 1*a* shows a schematic cross-sectional view of a water saving device in an example embodiment.

FIG. 1*a* shows the schematic diagram of the water saving device 100 in an example embodiment. The water saving device 100 comprises an enclosure 102, an upper flow regulating structure 104, a lower flow regulating structure 106 and a mesh socket 108. In the example embodiment, the enclosure 102 is made of material such as chromed metal. The enclosure 102 has threads 101 around its inner circumference. The threads 101 start from a top end of the enclosure 102 and extend to about half of the height of the enclosure 102. There is a rim 103 in the enclosure 102 near where the threads 101 end. The lower flow regulating structure 106 consists of a disk 113 and a ring housing 110.

Figure 1B:
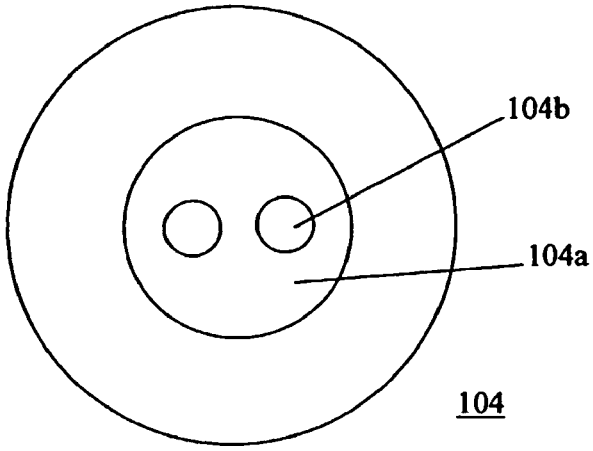
FIGS. 1*b*, 1*c* and 1*d* are schematic plan views of components of the water saving device of FIG. 1*a*.

FIG. 1*b* shows a plan view of the upper flow regulating structure 104 in an example embodiment. The upper flow regulating structure 104 has a circular protrusion 104*a* in the centre. There are two holes 104*b* aligned on a centre line on the surface of the protrusion 104*a* in the example embodiment. The two holes 104*b* extend from the surface of the protrusion 104*a* to the other side of the upper flow regulating structure 104. There are threads (not shown) around the outer circumference of the upper flow regulating structure 104.

Figure 1C:
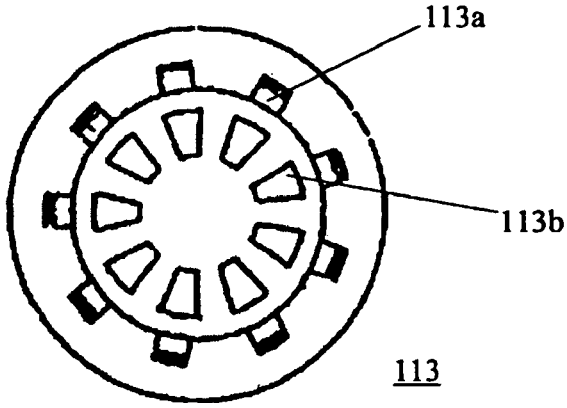

FIG. 1*c* shows a top view of the disk 113 of the lower flow regulating structure 106 (FIG. 1*a*) in an example embodiment. The disk 113 is made of thermosetting plastics. There are numerous small channels 113*a* around the circumference of the disk 113. A series of small protrusions 113*b* is arranged in a circular manner in front of the various channels 113*a*.

Referring back to FIG. 1*a*, the disk 113 is disposed in the ring housing 110. There is a rim 105 on the inner side of the ring housing 110 for receiving the top part 107 of the disk 113. The lower flow regulating structure 106 is then received in the mesh socket 108 in the example embodiment. Similarly, there is a rim 109 near one of the ends of the mesh socket 108 to receive the lower flow regulating structure 106. The disk 113, the ring housing 110 and the mesh socket 108 are designed to snap fit together in the example embodiment.

Figure 1D:
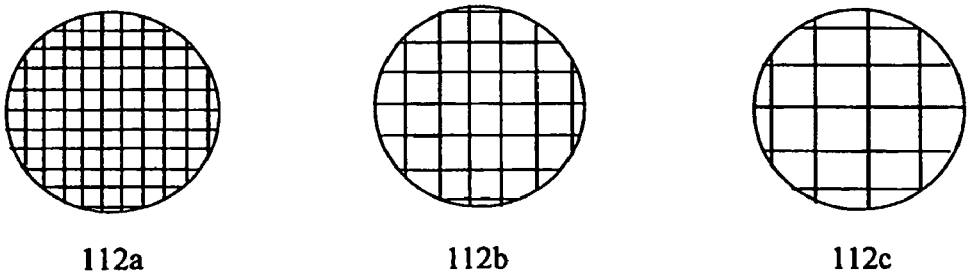

At the other end of the mesh socket 108, three meshes 112*a*, 112*b* and 112*c* are mounted, with the most dense mesh 112*a* as the topmost layer and the least dense mesh 112*c* as the bottom layer. FIG. 1*d* shows the three meshes 112*a*, 112*b* and 112*c* with different density in an example embodiment. The meshes 112*a*, 112*b* and 112*c* are made up of thin anti rust wire intercrossed to form a web-like structure. The meshes 11 2*a*, 11 2*b* and 11 2*c* facilitate a more even distribution of the water flow at a water outlet.

In the example embodiment, the structure 114 comprising of the lower flow regulating structure 106 and the mesh socket 108 is disposed in the enclosure 102 as shown in FIG. 1*a*. The top part of the structure 114 sits on the rim 103 of the enclosure 102 so that it will not fall through the enclosure 102.

After the structure 114 is disposed in the enclosure 102, the upper flow regulating structure 104 is screwed into the enclosure 102, with its flat surface 11 facing the lower flow regulating structure 106. A substantially airtight chamber 116 is created between the upper flow regulating structure 104 and lower flow regulating structure 106 in the example embodiment. It is noted that no deformable components such as neoprene O-ring are used in the engagement between the lower flow regulating structure 106, the mesh socket 108 and the enclosure 102. The disk 113 and the ring housing 110 are made from substantially solid materials. Due to the non-expandable nature of the solid materials under water pressure, leakage from the chamber 116 will be minimised, thus maintaining the water pressure in the chamber 116.

In the example embodiment, the water saving device 100 is designed such that the height of the chamber 116, which is the distance between the bottom layer of the upper flow regulating structure 104 and the top layer of the lower flow regulating structure 106, is about one-third of the diameter of a tap outlet 118. A distance may be varied to regulate a water force (and thus pressure) upon exit from the water saving device 100. It was found that a larger distance increases the water force and thus pressure.

Figure 2A:
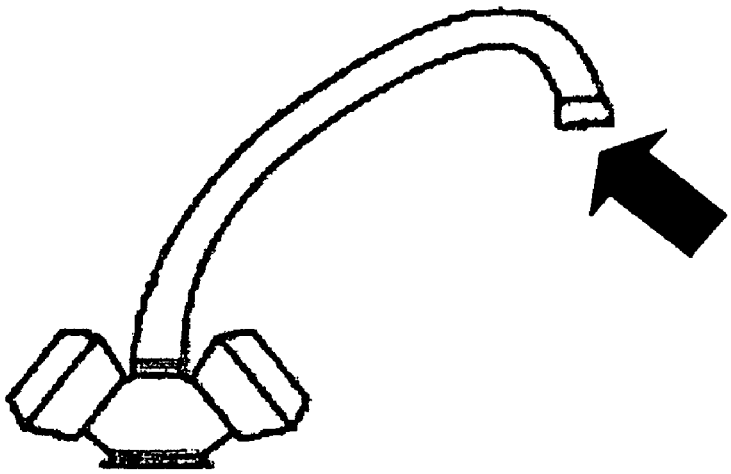
FIG. 2*a* and 2*b* are schematic drawings illustrating application of water saving devices according to example embodiments of the present invention being used in a water tap and in a shower head respectively.
Figure 2B:
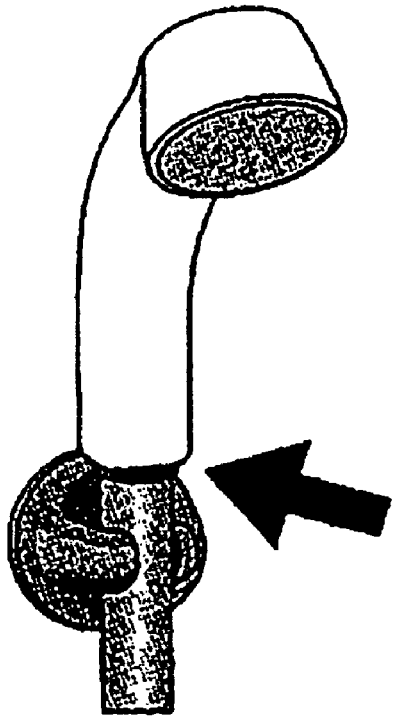

The water saving device 100 is screwed to the tap outlet 118 using the remaining threads of the enclosure 102 in an example embodiment. The water saving device 100 can be used on any water tap outlet such as e.g. illustrated in FIG. 2*a* or shower heads such as e.g. illustrated in FIG. 2*b* in example embodiments.

Water saving is carried out by positioning the water saving device 100 along the tap water line 120 at or near the water outlet. The water saving device 100 divides the tap water line 120 along the direction of flow through the means of holes e.g. 104*b* and channels e.g. 113*a* and thereby limits the flow of water. The volume of the water that flows out at tap water line 120*c* is thus significantly reduced.

However, as mentioned above, in comparison to the existing water saving devices, the water saving device in accordance with the example embodiment of the present invention can maintain increased pressure at the water outlet. FIG. 3 shows a comparison of measured pressures and flow rates at the water outlet between an existing water saving device and a water saving device in accordance with the example embodiment of the present invention.

As seen in FIG. 3, with the existing water saving device, when the flow rate is reduced to 28.8 liter/min, already the pressure at the outlet is reduced to 1.4 bar for a water tap from a typical line pressure in a household of 2.5 to 3 bar. However, with the water saving device in accordance with the example embodiment of the present invention, even at a flow rate of 13.8 liter/min, the outlet pressure is maintained at 2.4 bar. Similar experiments were conducted at a shower head with the existing water saving device and the water saving device in accordance with the embodiment of the present invention. FIG. 3 thus illustrates the advantages that can be achieved as a result of the minimisation of leakage in water saving devices according to embodiments of the present invention.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

The configuration of the example embodiments in FIGS. 1*a*-1*d* is not limited as aforementioned. The materials used for manufacturing the various components of the water saving device 100 are not restricted to those mentioned. The enclosure 102 may be formed by separate parts, e.g. top, middle and bottom enclosures instead of being an one-piece structure. The enclosure 102 and the upper flow regulating structure 104 may be secured together by bolts or welding. The number of holes 104*b* and channels 113*a* is not limited to that shown in FIGS. 1*b* and 1*c*. The holes 104*b* may adopt other shapes. The size of the water saving holes 104*b* and 113*a* is also not limited as shown in this configuration. The number and the density of the meshes 112 may vary in each water saving device 100.

The invention claimed is:

1. A water saving device for use at or near a water outlet, the device comprising:

a. an enclosure, the enclosure defining an internal volume and an internal thread, the enclosure being configured for an attachment to the water outlet;

b. a first water flow regulating element disposed within the internal volume, the first water flow regulating element having a largest outside circumference, the largest outside circumference of the first water flow regulating element defining an external thread, the external thread of the first water flow regulating element and the internal thread of the enclosure being in a threaded engagement, the first water flow regulating element having a location with respect to the enclosure, the location being selectable by the threaded engagement;

c. a second water flow regulating element disposed at a location within the internal volume and downstream of the first regulating element, the location of the second water flow regulating element being fixed with respect to the enclosure;

d. a substantially airtight chamber defined by the internal volume of the enclosure and bounded by the first regulating element in an upstream direction and the second regulating element in a downstream direction;

e. wherein a height of the substantially airtight chamber is defined by the selectable location of the first water flow regulating element and the fixed location of the second water flow regulating element, the height being adjustable; and f. wherein all of one or more water flow regulating parts of the first and second regulating elements are made from substantially solid non-deformable material.

2. The device as claimed in claim 1, wherein the height is adjustable by a rotation of the first regulating element with respect to the enclosure.

3. The device as claimed in claim 1, wherein the height is about ⅓ of a diameter of a water supply line for the outlet.

4. The device as claimed in claim 1, wherein the second regulating element is mounted within the chamber in a substantially airtight manner under water flow.

5. The device as claimed in claim 1, further comprising one or more netting elements disposed downstream of the second regulating element.

6. The device as claimed in claim 1, wherein the first regulating element comprises an array of holes, the holes defining an exclusive path for entry of water from the water outlet into the airtight chamber.

7. The device of claim 6 wherein the second water flow regulating element comprises an array of holes, the holes in the secondary water flow regulating element defining an exclusive path for exit of water from the water outlet through the airtight chamber

8. The device as claimed in claim 1, wherein the first regulating element comprises an array of holes substantially circular in shape.

9. The device as claimed in claim 1, wherein the attachment of the enclosure to the water outlet being a threaded attachment, the threaded attachment comprising: the internal thread of the enclosure being configured to engage a corresponding external thread of the water outlet.

10. The device of claim 9 wherein the first water flow regulating element defines a limit for the threaded attachment of the enclosure to the water outlet when the internal thread of the enclosure is in threaded engagement with the external thread of the water outlet.

11. The device of claim 1, wherein the pressure of water through the device is between 1 and 2 bars.

12. The device of claim 1, wherein the flow rate of water through the device is between 10 and 30 liters per minute.

13. A water saving device within a water outlet, the device comprising:

a. an enclosure, the enclosure defining an internal volume and an internal Thread;

b. a first water flow regulating element disposed within the internal volume, a largest outside circumference of the first water flow regulating element having an external thread, the external thread of the first water flow regulating element and the internal thread of the enclosure being in a threaded engagement, the first water flow regulating element having a location with respect to the enclosure, the location being selectable by the threaded engagement;

c. a second water flow regulating element disposed downstream of the first regulating element;

d. a substantially airtight chamber defined by the interior volume and bounded by the first regulating element in an upstream direction and the second regulating element in a downstream direction;

e. wherein the height of the substantially airtight chamber is adjustable; and f. wherein all of one or more water flow regulating parts of the first and second regulating elements are made from substantially solid non-deformable material.

14. The device of claim 13, wherein the water outlet is a water tap.

15. The device of claim 13, wherein the water device is a showerhead.

16. The device of claim 13 wherein the second water flow regulating element is in a fixed location with respect to the enclosure.

17. The device of claim 16 wherein the internal thread of the enclosure is configured for a threaded attachment to a corresponding external thread of the water outlet.

18. The device of claim 17 wherein the first water flow regulating element defines a limit for the threaded attachment of the enclosure to the water outlet when the internal thread of the enclosure is in the threaded attachment to the external thread of the water outlet.

* * * * *